US005686213A

United States Patent [19]

Cosgrove et al.

[11] Patent Number: 5,686,213

[45] Date of Patent: Nov. 11, 1997

[54] TUNABLE IMAGING MEMBERS AND PROCESS FOR MAKING

[75] Inventors: Robert T. Cosgrove; John S. Chambers, both of Rochester; Huoy-Jen Yuh, Pittsford, all of N.Y.

[73] Assignee: Xerox Corporation, Stamford, Conn.

[21] Appl. No.: 691,064

[22] Filed: Jul. 31, 1996

[51] Int. Cl.[6] ..... G03G 5/043

[52] U.S. Cl. ..... 430/56; 430/127

[58] Field of Search ..... 430/56, 58, 59, 430/135, 127

[56] References Cited

U.S. PATENT DOCUMENTS

| | | | |
|---|---|---|---|
| 3,871,882 | 3/1975 | Wiedemann | 96/1.5 |
| 3,904,407 | 9/1975 | Regensburger et al. | 96/1.5 |
| 4,251,612 | 2/1981 | Chu et al. | 430/59 |
| 4,265,990 | 5/1981 | Stolka et al. | 430/59 |
| 4,419,427 | 12/1983 | Graser et al. | 430/58 |
| 4,469,523 | 9/1984 | Ganci | 106/309 |
| 4,557,868 | 12/1985 | Page et al. | 260/245.89 |
| 4,578,333 | 3/1986 | Staudenmayer et al. | 430/60 |
| 4,587,189 | 5/1986 | Hor et al. | 430/59 |
| 5,019,473 | 5/1991 | Nguyen et al. | 430/58 |
| 5,084,100 | 1/1992 | Bauman | 106/495 |
| 5,225,307 | 7/1993 | Hor et al. | 430/136 |
| 5,484,674 | 1/1996 | Hor et al. | 430/59 |

FOREIGN PATENT DOCUMENTS 30 19 326 12/1981 Germany .

*Primary Examiner*—John Goodrow
*Attorney, Agent, or Firm*—Oliff & Berridge

[57] ABSTRACT

A method for forming an electrostatographic photoreceptor includes the steps of selecting a desired sensitivity range and a desired light intensity for a photoreceptor and forming the photoreceptor having the desired sensitivity range and desired light intensity. The photoreceptor includes a supporting substrate and a photogenerating layer including a charge generating material, formed by coating the photogenerating layer on the supporting substrate. The charge generating material is formed by a process including dispersion milling a photogenerating material for a selected period of time, selected in accordance with the desired sensitivity range and the desired light intensity, to adjust the desired sensitivity range and desired light intensity of the photoreceptor.

18 Claims, No Drawings

TUNABLE IMAGING MEMBERS AND PROCESS FOR MAKING

BACKGROUND OF THE INVENTION

This invention relates to imaging members and photoreceptors with tunable electrical response characteristics, and a process for their manufacture. More particularly, the present invention relates to a process for manufacturing benzimidazole perylene-containing photoreceptors having a tunable sensitivity and photo-induced discharge curve.

Imaging members of either single- or multi-layer design construction are known in the art. Certain layered imaging members are known, for example, including those comprised of separate charge generating layers and charge transport layers, as described in U.S. Pat. No. 4,265,990, the entire disclosure of which is incorporated herein by reference. Another form of imaging member includes overcoated photoresponsive materials containing a hole injecting layer overcoated with a hole transport layer, followed by an overcoating of a photogenerating layer, and a top coating of an insulating organic resin, as described in U.S. Pat. No. 4,251,612, the entire disclosure of which is incorporated herein by reference. Examples of photogenerating layers disclosed in these patents include trigonal selenium and phthalocyanines, while examples of transport layers include certain aryl diamines as mentioned therein.

Benzimidazole perylene pigments are generally known, as is their use in imaging members. For example, benzimidazole perylene pigments are disclosed in U.S. Pat. Nos. 4,587,189 and 5,225,307, the disclosures of which are totally incorporated herein by reference. Furthermore, U.S. Pat. No. 5,484,674, the disclosure of which is totally incorporated herein by reference, discloses layered photoconductive imaging members comprised of certain benzimidazole perylenes, wherein perylenes with improved photosensitivity and dispersion quality are generated by the contacting thereof with an organic solvent such as cyclohexane.

The use of selected perylene pigments as photoconductive substances is also known. For example, there is described in Hoechst European Patent Publication 0040402, DE 3019326, the use of N,N'-disubstituted perylene-3,4,9,10-tetracarboxyldiimide pigments as photoconductive substances. Specifically, for example, this publication discloses N,N'-bis(3-methoxypropyl)perylene-3,4,9,10-tetracarboxyld iimide dual layered negatively charged photoreceptors with improved spectral response in the wavelength region of 400 to 700 nanometers. There are also disclosed in U.S. Pat. No. 3,871,882 photoconductive substances comprised of specific perylene-3,4,9,10-tetracarboxylic acid derivative dyestuffs. In accordance with the teachings of this patent, the photoconductive layer is preferably formed by vapor depositing a dyestuff component in a vacuum. Also, there are specifically disclosed in this patent dual layer photoreceptors with perylene-3,4,9,10-tetracarboxylic acid diimide derivatives, which have spectral responses in the wavelength region of from 400 to 600 nanometers.

Moreover, there are disclosed in U.S. Pat. No. 4,419,427 electrophotographic recording media with a photoconductive double layer comprised of a first layer containing charge carrier perylene diimide dyes, and a second layer with one or more compounds that are charge transporting materials when exposed to light.

Various types of perylene pigments, having symmetrical as well as asymmetrical structures, are generally known in the art. Such perylenes can generally be prepared by reacting perylene tetracarboxylic acid dianhydride with primary amines or with diamines of aryl, alkyl, pyridyl, or naphthyl compounds. More specifically, the use of photoconductive perylene pigments obtained from perylene-3,4,9,10-tetracarboxylic acid dianhydride as photoconductors is disclosed in U.S. Pat. Nos. 3,871,882 and 3,904,407, the disclosures of which are totally incorporated herein by reference. U.S. Pat. No. 3,871,882 illustrates the use of perylene dianhydride and bisimides in general (R=H, lower alkyl such as $C_1$ to $C_4$, aryl, substituted aryl, arylalkyl, a heterocyclic group or the NHR' group in which R' is phenyl, substituted phenyl or benzoyl) as vacuum evaporated thin charge generation layers in photoconductive devices coated with a charge transporting layer. U.S. Pat. No. 3,904,407 illustrates the use of general bisimide compounds (R=alkyl, aryl, alkylaryl, alkoxyl or halogen, or heterocyclic substituent) with preferred pigments being those wherein R is chlorophenyl or methoxyphenyl. Perylenes and processes for their production are also illustrated in U.S. Pat. Nos. 5,019,473 and 5,225,307, the disclosures of which are totally incorporated herein by reference.

Photoresponsive members such as imaging members and photoreceptors generally contain a uniform layer of charge generator material, which is usually comprised of fine particles of photogenerator pigment. Consequently, there have been developed various processes to prepare the fine particles of pigment such that the final coating of the generator layer has a high dispersion quality, and controllable electrical and printing properties. However, photoreceptors containing photoconductive perylenes and the processes for production thereof described in a number of the prior art references have certain deficiencies. For example, in the processes of U.S. Pat. Nos. 4,587,189 and 4,578,333, a vacuum coating process is selected to prepare a submicron thick charge generator layer for the photoreceptor. This layer is usually thin, lacks substantial mechanical abrasion resistance, and can be easily damaged by rubbing and scratching during handling processes. This can severely increase the defects in the photoreceptor, which later cause printing defects.

In another approach, a sublimation process is selected to purify perylene pigments to remove detrimental impurities from the crude, synthesized materials. Such a process is disclosed, for example, in U.S. Pat. No. 5,225,307. Following the purification, a certain polymer binder dispersion of perylene is prepared by milling pigment, binder and solvent in accordance with this conventional approach. The photoreceptors prepared from such dispersions, however, suffer a significant loss in photosensitivity. Furthermore, there are various risks resulting from the prolonged milling process. For example, the polymer binder may break up into smaller fragments, resulting in unstable dispersions, due primarily to the loss of the stabilization effect provided by the polymer, and the poor coating uniformity of the charge generator.

Premilling processing is also commonly used in particle size reduction processes, such as practiced in the pigment and paint industries. Typically, in such a premilling process, the pigment is ground in the dry state with grinding media, such as steel balls, ceramic balls, or glass beads in jar mills, vibratory mills, or attritors. Inorganic salts, such as alkali halides, carbonates, sulfates or phosphates, are also added to the grinding mixture to improve process efficiency. High shear and mechanical impact forces produced in the grinding action break the pigment agglomerates into finer sizes. For example, in U.S. Pat. No. 5,019,473 there is illustrated the use of dry premilling steps for reducing the particle size of perylene pigments prior to using them in preparing charge generator dispersions. However, contaminants introduced by salts have to be thoroughly washed and removed, or separated from the pigments, otherwise final electrical and printing performance of the photoreceptors may be severely adversely affected. These multiple processing steps involve milling, washing, separation and drying, which severely increase the cost of the manufacturing process and the process variability. Furthermore, certain perylene pigments may have a high adhesion force and thus tend to stick together as large agglomerates, and the dry milling process such as described in U.S. Pat. No. 5,019,473 may not be effective in reducing the particle size. There is also a significant loss of material that remains stuck onto the wall of the preparation vessel used in processing the pigment, and a large particle size distribution is also observed.

Acid pasting processes for reducing pigment particle size are also generally known. For example, U.S. Pat. No. 4,557,868 discloses a phthalocyanine dissolved in concentrated sulfuric acid to form an acid mixture, which is then diluted in water to produce fine particles of phthalocyanine. The resulting fine particles are used to form the charge generator layer of a photoreceptor for electrophotographic applications. Many phthalocyanine pigments, such as VOPc, TiOPc, $H_2Pc$, and CuPc, have been reportedly treated in this manner. Unfortunately, the reaction of perylene and many pigments with acids result in chemical degradation and the formation of sulfonated products, which finally leads to poor electrical charging properties in the charge generator layer. As a result, the acid pasting process is not particularly suitable for preparing high quality, photoconductive perylene pigments.

Dispersion milling processes for other types of pigments and other materials are also generally known in the art. For example, U.S. Pat. Nos. 5,084,100 and 4,469,523, the entire disclosures of which are incorporated herein by reference, disclose dispersion milling processes for reducing the particle size of quinacridones. For example, U.S. Pat. No. 5,084,100 discloses a dispersion milling process wherein the quinacridone is milled in the presence of hydrated aluminum sulfate and a lower alkyl ester of $C_2$–$C_{10}$ dibasic carboxylic acid as a crystallizing solvent. The process generally comprises milling the quinacridone and solvent in a mill such as a ball mill with a suitable grinding media, e.g., steel shot, iron nails and spikes, or ceramic beads, for a time period of generally from 2 to 10 hours. U.S. Pat. No. 4,469,523 discloses a dispersion milling process wherein the quinacridone is milled to pigment-sized material by ball or rod milling the crude quinacridone with 3–10 parts of borax pentahydrate per part by weight pigment and 5–40% by weight (based on pigment) of a monohydric alcohol containing 4–8 carbon atoms of a polyethylene glycol having a molecular weight of 150–600. However, these references do not disclose that the milling process can be used to control the electrical response properties of the pigment for use in a photoreceptor.

However, the need continues to exist in the art for materials and processes for use in photoreceptors whereby the electrical response characteristics of the photoreceptors can be easily and consistently provided. For example, there is a need in the art for photoreceptors with specific sensitivities and photo-induced discharge curves such that the photoreceptors can provide high quality images. Moreover, however, there is a need for a process that will allow specific tuning of the electrical response characteristics without having to completely redesign the entire structure of the photoreceptor and/or provide different chemical components for the various photoreceptor layers.

SUMMARY OF THE INVENTION

These and other problems of the prior art are overcome by the processes and materials of the present invention.

The present invention provides a method for forming an electrostatographic photoreceptor, comprising:

(a) selecting a desired sensitivity range and a desired light intensity for a photoreceptor; and (b) forming said photoreceptor having said desired sensitivity range and said desired light intensity comprising a supporting substrate and a photogenerating layer comprising a charge generating material by coating said photogenerating layer on said supporting substrate;

wherein said charge generating material is formed by a process comprising dispersion milling a photogenerating material for a selected period of time, selected in accordance with said desired sensitivity range and said desired light intensity, to adjust said desired sensitivity range and said desired light intensity of said photoreceptor.

The present invention thus provides imaging members, and particularly photoreceptors, as well as a process for manufacturing such imaging members, whereby the electrical response characteristics of the photoreceptors may be tuned for a particular application. The present invention thus allows for many different products to be developed from one set of materials, thereby saving money in development costs and materials investment, as well as providing faster delivery of specific photoreceptors.

DETAILED DESCRIPTION OF PREFERRED EMBODIMENTS

Using the processes of the present invention, a photoreceptor may be fabricated to have specifically selectable electrical response characteristics. In general, to form photoreceptors, a substrate surface is coated with a blocking layer, a charge generating layer, and a charge transport layer. Optional adhesive undercoating, overcoating and anti-curl layers may also be included, as desired. Alternatively, a single photoconductive layer may be applied to the substrate. If desired, the sequence of the application of coatings of multi-layered photoreceptors can be varied. Thus, a charge transport layer may be applied prior to the charge generating layer, or a charge generating layer may be applied prior to the charge transport layer. The photoconductive coating may generally be homogeneous and typically contains particles dispersed in a film-forming binder. The homogeneous photoconductive layer may be organic or inorganic, and the dispersed particles in the layer may be organic or inorganic photoconductive particles.

In the photoreceptors of the present invention, the charge generating layer is formed using a benzimidazole perylene charge generating material (also referred to generally as a benzimidazole perylene pigment). Any of the known benzimidazole perylene charge generating materials suitable for use in photoreceptors may similarly be used in the photoreceptors of the present invention. For example, suitable benzimidazole perylene charge generating materials are disclosed in U.S. Pat. Nos. 4,587,189 and 5,225,307, incorporated herein by reference above. For example, the cis- and trans-isomers of benzimidazole perylene, having the formulas bisbenzimidazo(2,1-a:1',2'-b')anthra(2,1,9-def:6,5,10-d'e'f')diisoquinoline-6,11-dione and bisbenzimidazo(2,1-a:2',1'-a')anthra(2,1,9-def:6,5,10-d'e'f')diisoquinoline-10,21-dione are particularly suitable for use in the present invention.

Preferably, following processing of the benzimidazole perylene as described below, the resultant particles have an average particle size (average diameter) of from about 0.03 to about 0.20 μm. Preferably, the particles have an average particle size of from about 0.05 to about 0.15 μm, and more preferably from about 0.05 to about 0.1 μm.

According to the present invention, the benzimidazole perylene processing is conducted in accordance with the desired electrical response characteristics required of the resultant photoreceptor. That is, the present inventors have discovered that the particle processing parameters can be adjusted so as to provide particulate benzimidazole perylene, which, when used to form a photoreceptor with standard materials, provides desired electrical response characteristics such as sensitivity range and light intensities. These properties can thereby provide the photoreceptor with s specifically-tuned photo-induced discharge curve merely by altering the benzimidazole perylene processing rather than redesigning the photoreceptor structure and the charge generating layer and charge transport layer materials.

According to the present invention, the bulk benzimidazole perylene is processed by dispersion milling the material for a selected length of time. In particular, it has been discovered that despite the variation in the dispersion milling time, there is no observed change in the depletion voltage or voltage/charge density behavior of the resultant photoreceptor. That is, while the benzimidazole perylene processing may be used to alter the electrical response characteristics of the photoreceptor, the different processing does not significantly affect the relationship between the voltage applied to the photoreceptor and the charge density on the photoreceptor surface.

In embodiments of the present invention, the bulk benzimidazole perylene is dispersion milled for a time period of from about 2 to about 100 hours. The milling time will depend, of course, upon the desired electrical response characteristics of the photoreceptor into which the particulate material is to be incorporated. Furthermore, the processing time will depend upon such other factors as the type of milling apparatus used, the grinding media used in the milling apparatus, the physical characteristics (such as size) of the benzimidazole perylene starting material, and the like. Preferably, the milling time in embodiments of the present invention is from about 3 to about 75 hours, and more preferably from about 4 to about 65 hours. However, milling times outside of these ranges may suitably be used, and one skilled in the art will be able to adjust the milling time accordingly.

According to the present invention, it has been found that the electrical response characteristics of the photoreceptor are approximately directly related to the milling time of the benzimidazole perylene, when other factors (such as photoreceptor construction) are held constant. That is, it has been found that as milling time increases, the sensitivity (dV/dX, measured in V-cm$^2$/erg at a $V_{ddp}$ of 600 V) increases. Similarly, it has been found that as milling time increases, the light intensity (X, measured in erg/cm$^2$ at 100 V) decreases. At the same time, average particle size of the benzimidazole perylene also decreases as the milling time increases. Thus, by selecting an appropriate milling time based on the desired sensitivity and light intensity, a photoreceptor with a specifically desired photo-induced discharge curve may be provided.

In embodiments of the present invention, the photoreceptor preferably has a desired sensitivity and a desired light intensity such that the photoreceptor is capable of use in standard electrostatographic imaging processes. In particular, it is preferred that the photoreceptor has a sensitivity of from about 40 to about 90 V-cm$^2$/erg at a $V_{ddp}$ of 600 V, more preferably from about 50 to about 80 V-cm$^2$/erg. It is also preferred that the photoreceptor has a light sensitivity of from about 7 to about 25 erg/cm$^2$ at 100 V, and more preferably from about 10 about 20 erg/cm$^2$. According to the present invention, such electrical response characteristics may be readily obtained based on the relationship of the characteristics to the dispersion milling time.

The dispersion milling may be conducted using any suitable milling equipment. For example, the milling may be conducted in such equipment as a jar mill, a ball mill, an attritor, a sand mill, a paint shaker, a dyno mill, or a drum tumbler. Such equipment should also include a suitable grinding media of, for example, round, spherical or cylindrical grinding beads of steel balls, ceramic cylinders, glass balls, round agates or stones. In embodiments, the milling equipment may further include an amount of solvent such as cyclohexane to enable the production of a coating dispersion, which is used to coat the charge generating layer. Any suitable solvent may thus be employed, with the amount of solvent being adjusted so as to provide a suitable viscosity and to allow proper milling.

Alternatively, any other of the known milling operations and equipment may be used in embodiments of the present invention. The appropriate milling time range will vary depending upon the type of milling operation used, the milling media used in the equipment, and similar factors. The appropriate milling time to provide the desired electrical response characteristics are thus related to the specific milling operation, and can be selected accordingly.

The photoreceptors of the present invention thus contain benzimidazole perylene particles that provide the photoreceptor with the desired electrical response characteristics. These particles not only enable high photosensitivity in the photoreceptors, but also reduce the defects in the charge generating layers. Generally, large charge generating material particles greater than, for example, 10 to 15 μm in size are formed in the synthesis or purification process. For instance, the sublimation purification process used in purifying perylene pigments as described in U.S. Pat. No. 5,225,307 yields perylene particles that are several millimeters in length. For the coating of a thin charge generating layer, for example of from 0.2 to 1.0 μm in thickness, in a photoreceptor, small particle sizes in the submicron range, preferably less than 0.2 μm, are desired. Furthermore, the particle shape and morphology may affect the uniformity of the coated layer. For example, long needle-like particles have a tendency to flocculate into large aggregates and create an uneven deposition of charge generating particles on a microscopic scale, and hence lead to the formation of defect spots in the photoreceptor. Typically, areas containing a disproportionally large accumulation of charge generating material produce higher discharging whereas areas where depletion of charge generating material occurs would have a decrease in discharge. These non-uniformities may significantly impact the printing quality of the photoreceptor, such as resolution, image, uniformity, and image background.

The thus-produced particulate benzimidazole perylene may be used to form any of the various designs of photoreceptors according to processes known in the art.

The benzimidazole perylene particles prepared according to embodiments of the present invention can be used directly in preparing thin charge generating layers for photoreceptors. For improved film generating coating properties and excellent mechanical properties, it is generally preferred to redisperse the prepared benzimidazole perylene particles in a polymer solution. For example, suitable polymer solutions include, but are not limited to, polycarbonate in toluene or tetrahydrofuran, or polystyrene-b-vinylpyridine in toluene. Typically, the polymer solution contains from about 0.01 to about 1 part by weight of polymer and 10 parts by weight of solvent. The final amount of benzimidazole perylene dispersed in the polymer solution may generally range from about 5 to about 95 percent by weight, and preferably from about 30 to about 80 percent by weight of the total solution. Photoreceptors containing such a charge generating layer according to the present invention evidence improved qualities such as photosensitivity and uniform dispersion quality. The benzimidazole perylene particles obtained with the processes of the present invention possess, for example, improved photosensitivity and excellent dispersion quality in photoreceptors after the particles have been dispersion milled.

The substrate for the photoreceptor can be formulated entirely of an electrically conductive material, or it can be comprised of an insulating material having an electrically conductive surface. The substrate can be of an effective thickness, generally up to about 100 mils, and preferably from about 1 to about 50 mils, although the thickness can be outside of this range as desired. The thickness of the substrate layer depends on many factors, including, for example, economic and mechanical considerations. Thus, the substrate layer may be of substantial thickness, for example over 100 mils, or of a minimal thickness, provided that there are no adverse effects thereof. In a particularly preferred embodiment, the thickness of the substrate layer is from about 3 mils to about 10 mils. The substrate can be opaque or substantially transparent and can comprise numerous suitable materials having the desired mechanical properties.

The entire substrate can comprise the same material as that in the electrically conductive surface, or the electrically conductive surface can merely be a coating on the substrate. Any suitable electrically conductive material can be employed for the electrically conductive surface. Typical electrically conductive materials include copper, brass, nickel, zinc, chromium, stainless steel, conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the photoreceptor. Generally, the conductive layer ranges in thickness of from about 50 Angstroms to many centimeters, although the thickness can be outside of this range as desired. When a flexible photoreceptor is desired, the thickness typically may be from about 100 Angstroms to about 750 Angstroms.

The substrate can be of any other conventional material, including organic and inorganic materials. Typical substrate materials include insulating nonconducting materials such as various resins known for this purpose, including but not limited to, polycarbonates, polyamides, polyurethanes, paper, glass, plastic, polyesters, such as MYLAR™ (available from E.I. DuPont) or MELINEX™ (available from ICI Americas, Inc.), and the like. If desired, a conductive material can be coated onto an insulating substrate. In addition, the substrate can comprise a metallized plastic, such as titanized or aluminized MYLAR™, wherein the metallized surface is in contact with the photogenerating layer or any other layer situated between the substrate and the photogenerating layer. The coated or uncoated substrate can be flexible or rigid, and can have any number of configurations, such as a plate, a cylindrical drum, a scroll, an endless flexible belt, or the like. The outer surface of the substrate preferably comprises a metal oxide such as aluminum oxide, nickel oxide, titanium oxide, or the like.

In embodiments, intermediate adhesive layers situated between the substrate and subsequently applied layers may be desirable to improve adhesion. When such adhesive layers are utilized, they preferably have a dry thickness of from about 0.1 μm to about 5 μm, although the thickness can be outside of this range. Typical adhesive layers include film forming polymers such as polyester, polyvinylbutyral, polyvinylpyrrolidone, polycarbonate, polyurethane, polymethylmethacrylate, and the like, as well as mixtures thereof. Since the surface of the substrate can be a metal oxide layer or an adhesive layer, the expression "substrate" can include a metal oxide layer with or without an adhesive layer on a metal oxide layer.

The photogenerating layer is of an effective thickness, for example, of from about 0.05 μm to about 10 μm or more, and in embodiments has a thickness of from about 0.2 μm to about 2 μm. The thickness of this layer can be dependent primarily upon the concentration of charge generating material in the layer, which may generally vary from about 5 to 100 percent by weight of the layer. The 100 percent value generally occurs when the photogenerating layer is prepared by vacuum evaporation of the charge generating material or by coating a binderless dispersion of the charge generating material onto the photoreceptor. For example, benzimidazole perylene such as produced according to the present invention is especially suited for application as a binderless material. When the photogenerating material is present in a binder material, the binder preferably contains from about 20 to about 95 percent by weight of the photogenerating material, and more preferably from about 50 to about 80 percent by weight of the photogenerating material. Generally, it is desirable to provide this layer in a thickness sufficient to absorb about 90 to about 95 percent or more of the incident radiation that is directed upon it in the imagewise or printing exposure step. The maximum thickness of this layer is dependent primarily upon factors such as mechanical considerations, such as the specific photogenerating compound selected, the thicknesses of the other layers, and whether a flexible photoreceptor is desired. In embodiments, the benzimidazole perylene charge generating material is preferably not dispersed in a resinous binder.

Typical charge transport layers that may be used in photoreceptors of the present invention are described, for example, in U.S. Pat. Nos. 4,265,990, 4,609,605, 4,297,424 and 4,921,773, the disclosures of each of these patents being totally incorporated herein by reference. Organic charge transport materials can also be employed.

Typical charge transporting materials, and particularly hole transporting materials, include but are not limited to hole transport molecules of the type described in U.S. Pat. Nos. 4,306,008, 4,304,829, 4,233,384, 4,115,116, 4,299,897, 4,081,274 and 5,139,910, the disclosures of each being totally incorporated herein by reference, can be selected for the photoreceptors of the present invention. Typical diamine hole transport molecules include: N,N'-diphenyl-N,N'-bis(3-methylphenyl)-(1,1'-biphenyl)-4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)-4,4'-diamine, N,N'-diphenyl-N,N'-bis(3-ethylphenyl)-(1,1'- biphenyl)-4,4'-diamine, N,N'-diphenyl-N,N'-bis(4-ethylphenyl)-(1,1'-biphenyl)-4,4'-diamine, N,N'-diphenyl-N,N'-bis(4-n-butylphenyl)-(1,1'-biphenyl)-4,4'-diamine, N,N'-diphenyl-N,N'-bis(3-chlorophenyl)-(1,1'-biphenyl)-4,4'-diamine, N,N'-diphenyl-N,N'-bis(4-chlorophenyl)-(1,1'-biphenyl)-4,4'-diamine, N,N'-diphenyl-N,N'-bis(phenylmethyl)-(1,1'-biphenyl)-4,4'-diamine, N,N,N',N'-tetraphenyl-[2,2'-dimethyl-1,1'-biphenyl]-4,4'-diamine, N,N,N',N'-tetra-(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like.

In embodiments of the present invention, the preferred hole transport layer, since it enables excellent effective transport of charges, is comprised of aryldiamine components as represented, or essentiallyrepresented, by the following general formula

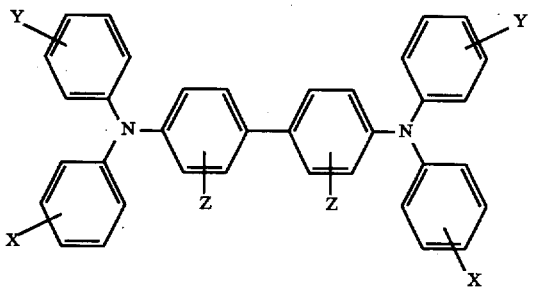

wherein X, Y and Z are selected from the group consisting of hydrogen, an alkyl group with, for example, from 1 to about 25 carbon atoms and a halogen, preferably chlorine, and at least one of X, Y and Z is independently an alkyl group or chlorine. When Y and Z are hydrogen, the charge transport molecules are N,N'-diphenyl-N,N'-bis(alkylphenyl)-(1,1'-biphenyl)-4,4'-diamine wherein alkyl is, for example, methyl, ethyl, propyl, n-butyl, or the like, or N,N'-diphenyl-N,N'-bis(chlorophenyl)-(1,1'-biphenyl)-4,4'-diamine.

The charge transport material may be present in the charge transport layer in any effective amount, generally from about 5 to about 90 percent by weight, preferably from about 20 to about 75 percent by weight, and more preferably from about 30 to about 60 percent by weight.

Examples of the highly insulating and transparent resinous components or inactive binder resinous material for the transport layer include, but are not limited to, materials such as those described in U.S. Pat. No. 3,121,006, the disclosure of which is totally incorporated herein by reference. Specific examples of suitable organic resinous materials include, but are not limited to, polycarbonates, acrylate polymers, vinyl polymers, cellulose polymers, polyesters, polysiloxanes, polyamides, polyurethanes, polystyrenes, epoxies, as well as block, random or alternating copolymers thereof, mixtures thereof and the like. Preferred electrically inactive binder materials are polycarbonate resins having a weight average molecular weight of from about 20,000 to about 100,000, with a weight average molecular weight in the range of from about 50,000 to about 100,000 being particularly preferred. Generally, the resinous binder contains from about 5 to about 90 percent by weight of the active material, and preferably from about 20 percent to about 75 percent by weight of this material.

Similar binder materials may optionally be selected for the photogenerating layer, including but not limited to polyesters, polyvinyl butyrals, polyvinylcarbazole, polycarbonates, polyvinyl formals, poly(vinylacetals) and those illustrated in U.S. Pat. No. 3,121,006, the disclosure of which is totally incorporated herein by reference.

The photoconductive photoreceptor may optionally contain a charge blocking layer situated between the conductive substrate and the photogenerating layer. This layer may comprise metal oxides, such as aluminum oxide and the like, or materials such as silanes and nylons. Additional examples of suitable materials include, but are not limited to, polyisobutyl methacrylate, copolymers of styrene and acrylates such as styrene/n-butyl methacrylate, copolymers of styrene and vinyl toluene, polycarbonates, alkyl substituted polystyrenes, styrene-olefin copolymers, polyesters, polyurethanes, polyterpenes, silicone elastomers, mixtures thereof, copolymers thereof, and the like. The primary purpose of this layer is to prevent charge injection from the substrate during and after charging. This layer may be of any suitable and effective thickness, and is preferably of a thickness of from less than about 50 Angstroms to about 10 microns. More preferably the thickness of the charge blocking layer is of no more than about 2 μm.

In addition, the photoreceptor may also optionally contain an adhesive interface layer situated between the hole blocking layer and the photogenerating layer. This layer may comprise a polymeric material such as polyester, polyvinyl butyral, polyvinyl pyrrolidone and the like. Typically, this layer is of a thickness of less than about 0.6 μm.

The benzimidazole perylene charge generating compounds of the present invention, in embodiments thereof, enable enhanced photosensitivity in the visible wavelength range. In particular, imaging members with photosensitivity at wavelengths of from about 400 to about 800 nanometers are provided in embodiments of the present invention, which renders them particularly useful for color copying, and imaging and printing applications, such as red LED and diode laser printing processes, which typically require sensitivity at about 600 to about 800 nanometers.

The present invention also encompasses a method of generating images with the photoreceptors disclosed herein. The method comprises the steps of generating an electrostatic latent image on a photoreceptor of the present invention, developing the latent image with a toner comprised of resin, pigment such as carbon black, and a charge additive, and transferring the developed electrostatic image to a substrate. Optionally, the transferred image can be permanently affixed to the substrate. Development of the image may be achieved by a number of known development methods, such as cascade, touchdown, powder cloud, magnetic brush, and the like. Transfer of the developed image to a substrate may be by any suitable method, including those making use of a corotron or a biased roll. The fixing step may be performed by means of any suitable method, such as flash fusing, heat fusing, pressure fusing, vapor fusing, and the like. Any material generally used in electrostatographic copiers and printers may be used as a substrate, such as paper, transparency material, or the like. Modification of these development processes will also be apparent to one skilled in the art.

It will also be readily apparent to one skilled in the art that the processing of the present invention is not limited to photoreceptors using benzimidazole perylene as the charge generating material. Rather, the dispersion milling processing of the present invention, whereby specific photo-induced discharge curves and electrical response characteristics of the photoreceptor are selected based only upon the milling time of the charge generating material, may be readily applied to the processing of other materials. Examples of other suitable charge generating materials that can be used in embodiments of the present invention include inorganic photoconductive particles such as amorphous selenium, trigonal selenium, and selenium alloys such as selenium-tellurium, selenium-tellurium-arsenic and selenium arsenide, phthalocyanine pigment such as the X-form of metal free phthalocyanine described in U.S. Pat. No. 3,357,989, metal phthalocyanines such as vanadyl phthalocyanine and copper phthalocyanine, dibromoanthanthrone, squarylium, quinacridones, dibromo anthanthrone pigments, substituted 2,4-diamino-triazines such as disclosed in U.S. Pat. No. 3,442,781, polynuclear aromatic quinones such as available from Allied Chemical Corporation under the tradenames Indofast Double Scarlet, Indofast Violet Lake B, Indofast Brilliant Scarlet and Indofast Orange, and the like.

The invention will now be described in detail with reference to specific preferred embodiments thereof. All parts and percentages are by weight unless otherwise indicated.

EXAMPLES

Example 1

A multi-layer photoreceptor is formed having an aluminum substrate, a blocking layer, a charge generating layer, and a charge transport layer. In this Example, it is desired that the photoreceptor have a sensitivity dV/dX of about 44 V-cm$^2$/erg at a $V_{ddp}$ of 600 V, and a light intensity at 100 V of about 24 erg/cm$^2$.

The substrate used in forming the photoreceptor is a honed aluminum substrate. To the aluminum substrate is applied a blocking layer. The blocking layer is formed at a thickness of 1.5 μm using Luckamide, a polyaminoamide manufactured by Dainippon Ink Co., Ltd. The blocking layer is formed by mixing the Luckamide with a suitable solvent and dip coating the Luckamide onto the substrate, Although not necessary, the Luckamide blocking layer is dried prior to subsequent processing.

Following application of the blocking layer, a charge generating layer is applied. The charge generating layer is applied at a rate of 350 mm/min and to a thickness of 0.5 μm. The charge generating layer is applied by a dip coating method to have an optical density of greater than 1.0. The material used to form the charge generating layer is a solution of benzimidazole perylene and PVB B79, a polyvinylbutyral manufactured by Monsanto, having a P:B (polybenzimidazole perylene to polymeric binder (polyvinylbutyral)) ratio of 68:32. The benzimidazole perylene and PVB B79 are formed in a dispersion of n-butyl acetate to form a dispersion having 7% by weight of solids.

In this Example, the benzimidazole perylene is formed from bulk benzimidazole perylene, ground to an appropriate particle size by the process of the present invention to provide the desired electrical response characteristics. In particular, the benzimidazole perylene is dispersion milled in a Dynomill (0.6 L chamber) set in recirculation mode. The grinding media used in the mill is zirconlure oxide media having a particle size of 450 μm, and the mill is operated at a speed of 2,000 rpm and at a flow rate of 150 mL/min. The batch size is set at 5 L. For the charge generating layer of this photoreceptor, the benzimidazole perylene is milled for 4 hours, which yields a particle size of 0.14 μm. In this Examples, the particle sizes are measured using a Horiba CAPA 700 centrifugal device.

Without allowing the charge generating layer to dry, a charge transport layer is applied over the charge generating layer. The charge transport layer is formed by coating upon the charge generating layer a 24 μm thickness layer of a solution of 60 parts by weight PCZ-400 (a polycarbonate resin available from Mitsubishi Gas Chemicals Co.) and 40 parts by weight of N,N'-diphenyl-N,N'-bis[3-methylpropyl]-[1,1'-biphenyl]-4,4'-aliamine. he charge transport layer is applied by a dip coating process.

The photoreceptor is then tested for its electrical response characteristics using an Advanced Products Concepts and Technologies area scanner. The photoreceptor provides the desired sensitivity dV/dX of 44 V-cm$^2$/erg at a $V_{ddp}$ of 600 V, and light intensity at 100 V of 24 erg/cm$^2$.

Examples 2–10

Multi-layer photoreceptors are prepared according to the same procedures and using the same materials as in Example 1. However, in Examples 2–10 the benzimidazole perylene is milled for different periods of time to provide the resultant photoreceptors with different desired sensitivity ranges and light intensities. The milling times, resultant benzimidazole perylene particle sizes, sensitivity ranges, and light intensities of Examples 2–10 are shown in Table 1.

Each of the photoreceptors of Examples 1–10 show excellent image quality under the desired development conditions. These Examples further show that by using the process of the present invention, the electrical response characteristics of the photoreceptor can be adjusted to desired values while using the same materials.

TABLE 1

| Example | Milling Time (hr) | Average Particle Size (μm) | dV/dX (V-cm$^2$/erg) | X (erg/cm$^2$) |
|---|---|---|---|---|
| 1 | 4 | 0.14 | 44 | 24 |
| 2 | 7 | 0.09 | 55 | 21 |
| 3 | 11 | 0.10 | 60 | 17 |
| 4 | 15 | 0.08 | 62 | 15 |
| 5 | 19 | 0.08 | 65 | 14 |
| 6 | 25 | 0.06 | 68 | 13 |
| 7 | 30 | 0.06 | 72 | 13 |
| 8 | 35 | 0.06 | 73 | 13 |
| 9 | 40 | 0.06 | 74 | 12 |
| 10 | 65 | 0.05 | 90 | 9 |

What is claimed is:

1. A method for forming an electrostatographic photoreceptor, comprising:

(a) selecting a desired sensitivity range and a desired light intensity for a photoreceptor; and (b) forming said photoreceptor having said desired sensitivity range and said desired light intensity comprising a supporting substrate and a photogenerating layer comprising a charge generating material by coating said photogenerating layer on said supporting substrate;

wherein said charge generating material is formed by a process comprising dispersion milling a photogenerating material for a selected period of time, selected in accordance with said desired sensitivity range and said desired light intensity, to adjust said desired sensitivity range and said desired light intensity of said photoreceptor.

2. The method of claim 1, wherein said photogenerating layer comprises a separate charge generating layer and a separate charge transport layer, and said charge generating material is contained in said charge generating layer.

3. The method of claim 1, wherein said photoreceptor has a sensitivity in a range of from about 40 to about 90 V-cm$^2$/erg at a $V_{ddp}$ of 600 V.

4. The method of claim 1, wherein said photoreceptor has a light intensity in a range of from about 7 to about 25 erg/cm$^2$ at 100 V.

5. The method of claim 2, wherein said photoreceptor forming step comprises providing said supporting substrate, applying a blocking layer to said supporting substrate, applying said charge generating layer over said blocking layer, and applying said charge transport layer over said charge generating layer.

6. The method of claim 1, wherein particles of said charge generating material have an average particle size of from about 0.03 to about 0.20 μm.

7. The method of claim 1, wherein particles of said charge generating material have an average particle size of from about 0.05 to about0.15 μm.

8. The method of claim 1, wherein said charge generating material is selected from the group consisting of amorphous selenium, trigonal selenium, selenium alloys, metal-free phthalocyanine pigments, metal phthalocyanines, dibromoanthanthrone, squarylium, quinacridones, dibromo anthanthrone pigments, substituted 2,4-diamino-triazines, and polynuclear aromatic quinones.

9. The method of claim 1, wherein said photogenerating material and said charge generating material are benzimidazole perylene.

10. The method of claim 9, wherein said benzimidazole perylene is selected from the group consisting of bisbenzimidazo(2,1-a:1',2'-b')anthra(2,1,9-def:6,5,10-d'e'f') diisoquinoline-6,11-dione and bisbenzimidazo(2,1-a:2',1'-a') anthra(2,1,9-def:6,5,10-d'e'f')diisoquinoline-10,21-dione.

11. The method of claim 1, wherein said period of time is from about 2 to about 100 hours.

12. The method of claim 1, wherein said dispersion milling is conducted in a milling apparatus selected from the group consisting of a jar mill, a ball mill, an attritor, a sand mill, a paint shaker, a dyno mill, and a drum tumbler, said milling apparatus including a grinding media selected from the group consisting of round, spherical or cylindrical grinding beads of steel balls, ceramic cylinders, glass balls, round agates and stones.

13. The method of claim 1, wherein said dispersion milling grinds said photogenerating material to a smaller size to form said charge generating material.

14. A method for tuning sensitivity and light intensity of an electrostatographic photoreceptor, comprising:

(a) selecting a desired sensitivity range and a desired light intensity for a photoreceptor;

(b) dispersion milling a photogenerating material for a period of time sufficient to provide said photogenerating material with said desired sensitivity range and said desired light intensity; and (c) forming said photoreceptor having said desired sensitivity range and said desired light intensity by a process comprising coating a photogenerating layer comprising a charge generating material onto a supporting substrate.

15. An electrostatographic photoreceptor having a specific desired sensitivity range and specific desired light intensity, produced by the process of claim 1.

16. An electrostatographic photoreceptor having a specifically-tuned sensitivity range and specifically-tuned light intensity, produced by the process of claim 14.

17. The method of claim 1, wherein said charge generating material is selected from the group consisting of amorphous selenium, trigonal selenium, selenium alloys, metal-free phthalocyanine pigments, metal phthalocyanines, dibromoanthanthrone, squarylium, dibromo anthanthrone pigments, and substituted 2,4-diamino-triazines.

18. The method of claim 1, wherein said dispersion milling is conducted in a milling apparatus and consists essentially of milling said photogenerating material with a grinding media and optionally a solvent.

* * * * *